US008144098B2

(12) United States Patent
Li et al.

(10) Patent No.: US 8,144,098 B2
(45) Date of Patent: Mar. 27, 2012

(54) DOT-MATRIX DISPLAY REFRESH CHARGING/DISCHARGING CONTROL METHOD AND SYSTEM

(75) Inventors: I-Yin Li, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 785 days.

(21) Appl. No.: 12/137,604

(22) Filed: Jun. 12, 2008

(65) Prior Publication Data

US 2009/0109157 A1 Apr. 30, 2009

(30) Foreign Application Priority Data

Oct. 30, 2007 (TW) ..... 96140723 A

(51) Int. Cl.
*G09G 3/36* (2006.01)

(52) U.S. Cl. ..... 345/92; 345/87; 345/96

(58) Field of Classification Search ..... 345/55, 345/59, 79, 82, 92, 96, 98, 100, 204, 209
See application file for complete search history.

(56) References Cited

U.S. PATENT DOCUMENTS

| | | | | |
|---|---|---|---|---|
| 5,852,426 | A * | 12/1998 | Erhart et al. | 345/96 |
| 5,949,391 | A * | 9/1999 | Saishu et al. | 345/50 |
| 6,501,226 | B2 * | 12/2002 | Lai et al. | 315/169.1 |
| 6,977,635 | B2 * | 12/2005 | Ogawa et al. | 345/93 |
| 7,015,884 | B2 * | 3/2006 | Kwon | 345/78 |
| 2002/0118154 | A1 * | 8/2002 | Kim | 345/87 |
| 2007/0030233 | A1 * | 2/2007 | Chai et al. | 345/98 |

FOREIGN PATENT DOCUMENTS

JP 09212137 A * 8/1997

* cited by examiner

*Primary Examiner* — Sumati Lefkowitz
*Assistant Examiner* — Jose Soto Lopez
(74) *Attorney, Agent, or Firm* — Pearne & Gordon LLP

(57) ABSTRACT

A dot-matrix display data refresh charging/discharging control method and system is proposed, which is designed for integration to a dot-matrix display device for providing a data refresh charging/discharging control mechanism on the dot-matrix display device. The proposed method and system is characterized by the capability of prior to a data refresh action on each pixel, switching the pixel for connection to a voltage-neutralizing point for the purpose of neutralizing the current data voltage charge on the pixel to substantially approach zero voltage level; and subsequently during the data refresh action, charging a new data voltage into the pixel. This feature allows the operation of the dot-matrix display device to have faster speed and low power consumption.

7 Claims, 7 Drawing Sheets

| FRAME(N) | | | | | |
|---|---|---|---|---|---|
| | C1 | C2 | C3 | C4 | C5 |
| R1 | + | + | + | + | + |
| R2 | + | + | + | + | + |
| R3 | + | + | + | + | + |
| R4 | + | + | + | + | + |
| R5 | + | + | + | + | + |

| FRAME(N+1) | | | | | |
|---|---|---|---|---|---|
| | C1 | C2 | C3 | C4 | C5 |
| R1 | − | − | − | − | − |
| R2 | − | − | − | − | − |
| R3 | − | − | − | − | − |
| R4 | − | − | − | − | − |
| R5 | − | − | − | − | − |

FIG. 2A

| FRAME(N) | | | | | |
|---|---|---|---|---|---|
| | C1 | C2 | C3 | C4 | C5 |
| R1 | + | + | + | + | + |
| R2 | − | − | − | − | − |
| R3 | + | + | + | + | + |
| R4 | − | − | − | − | − |
| R5 | + | + | + | + | + |

| FRAME(N+1) | | | | | |
|---|---|---|---|---|---|
| | C1 | C2 | C3 | C4 | C5 |
| R1 | − | − | − | − | − |
| R2 | + | + | + | + | + |
| R3 | − | − | − | − | − |
| R4 | + | + | + | + | + |
| R5 | − | − | − | − | − |

FIG. 2B

| FRAME(N) | | | | | |
|---|---|---|---|---|---|
| | C1 | C2 | C3 | C4 | C5 |
| R1 | + | − | + | − | + |
| R2 | + | − | + | − | + |
| R3 | + | − | + | − | + |
| R4 | + | − | + | − | + |
| R5 | + | − | + | − | + |

| FRAME(N+1) | | | | | |
|---|---|---|---|---|---|
| | C1 | C2 | C3 | C4 | C5 |
| R1 | − | + | − | + | − |
| R2 | − | + | − | + | − |
| R3 | − | + | − | + | − |
| R4 | − | + | − | + | − |
| R5 | − | + | − | + | − |

FIG. 2C

| FRAME(N) | | | | | |
|---|---|---|---|---|---|
| | C1 | C2 | C3 | C4 | C5 |
| R1 | + | − | + | − | + |
| R2 | − | + | − | + | − |
| R3 | + | − | + | − | + |
| R4 | − | + | − | + | − |
| R5 | + | − | + | − | + |

| FRAME(N+1) | | | | | |
|---|---|---|---|---|---|
| | C1 | C2 | C3 | C4 | C5 |
| R1 | − | + | − | + | − |
| R2 | + | − | + | − | + |
| R3 | − | + | − | + | − |
| R4 | + | − | + | − | + |
| R5 | − | + | − | + | − |

FIG. 2D

DOT-MATRIX DISPLAY REFRESH CHARGING/DISCHARGING CONTROL METHOD AND SYSTEM

BACKGROUND OF THE INVENTION

1. Field of the Invention

This invention relates to dot-matrix display technology, and more particularly, to a dot-matrix display data refresh charging/discharging control method and system which is designed for integration to a dot-matrix display device, such as a TFT-LCD (Thin Film Transistor Liquid Crystal Display) or an FSC (Field Sequential Color) device, for providing a data refresh charging/discharging control mechanism on the dot-matrix display device.

2. Description of Related Art

TFT-LCD (Thin Film Transistor Liquid Crystal Display) and FSC (Field Sequential Color) are two widely used dot-matrix display technologies on portable electronic devices such as notebook computers and intelligent mobile phones. In practice, a TFT-LCD or FSC device is equipped with an N×M dot matrix which is an array of N rows and M columns of pixels, wherein each pixel is capable of displaying a particular color value in response to the charging of a particular level of data voltage thereto.

With technological advance, dot-matrix display devices have evolved from the early 640×480 resolution to modern high-definition resolutions such as 1920×1080 or higher. However, due to the increase in the amount of pixels, one important issue in the design of these high-definition dot-matrix display devices is that the data-refresh process should be faster in order to maintain real-time display of video data. In other words, the data-voltage charging action on each pixel should be completed in a shorter time period. Moreover, since portable electronic devices as notebook computers and intelligent mobile phones are typically powered by batteries which can supply electrical power for only a few hours, another important issue in the design of dot-matrix display devices is low power consumption.

In view of the foregoing issues in the design of dot-matrix display devices, there exists therefore a need in the electronic and computer industry for a new and improved dot-matrix display technology that allows faster data-refresh process and low power consumption in the operation of dot-matrix display devices.

SUMMARY OF THE INVENTION

It is therefore an objective of this invention to provide a dot-matrix display data refresh charging/discharging control method and system which is capable of allowing faster data-refresh process and low power consumption in the operation of dot-matrix display devices.

The dot-matrix display data refresh charging/discharging control method and system according to the invention is characterized by the capability of prior to a data refresh action on each pixel, switching the pixel for connection to a voltage-neutralizing point for the purpose of neutralizing the current data voltage charge on the pixel to substantially approach zero voltage level; and subsequently during the data refresh action, charging a new data voltage into the pixel. This feature can effectively help speed up the data-refresh process with reduced power consumption, thus allowing the operation of the dot-matrix display device to have faster speed and low power consumption.

BRIEF DESCRIPTION OF DRAWINGS

The invention can be more fully understood by reading the following detailed description of the preferred embodiments, with reference made to the accompanying drawings, wherein:

FIGS. 2A-2D are schematic diagrams respectively showing four different types of polarity inversion schemes typically used on a dot-matrix display device;

DETAILED DESCRIPTION OF PREFERRED EMBODIMENTS

The dot-matrix display data refresh charging/discharging control method and system according to the invention is disclosed in full details by way of preferred embodiments in the following with reference to the accompanying drawings.

Function and Application of the Invention

Figure 1A:
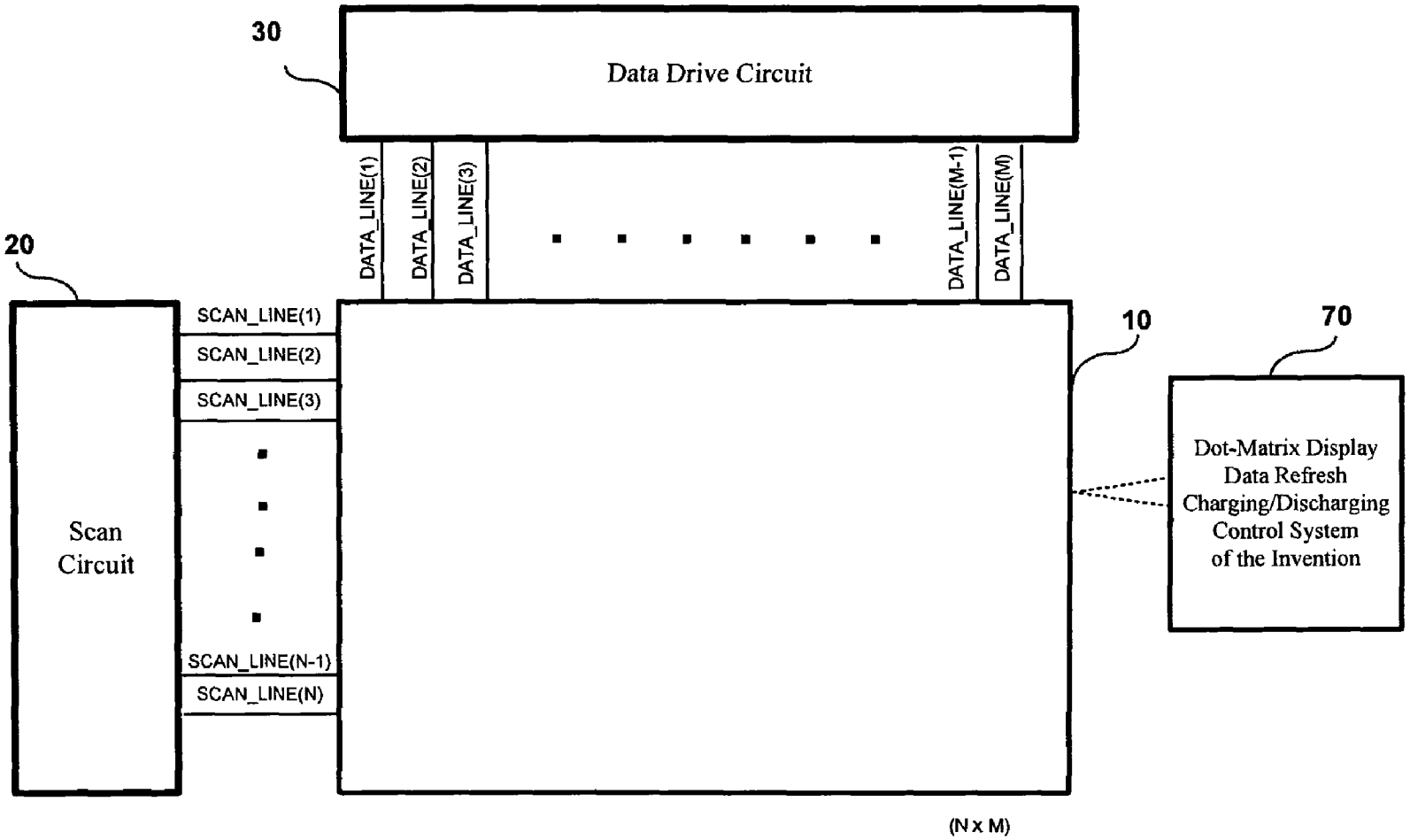
FIGS. 1A-1B are schematic diagrams showing the application of the dot-matrix display data refresh charging/discharging control system of the invention with a dot-matrix display device.
Figure 1B:
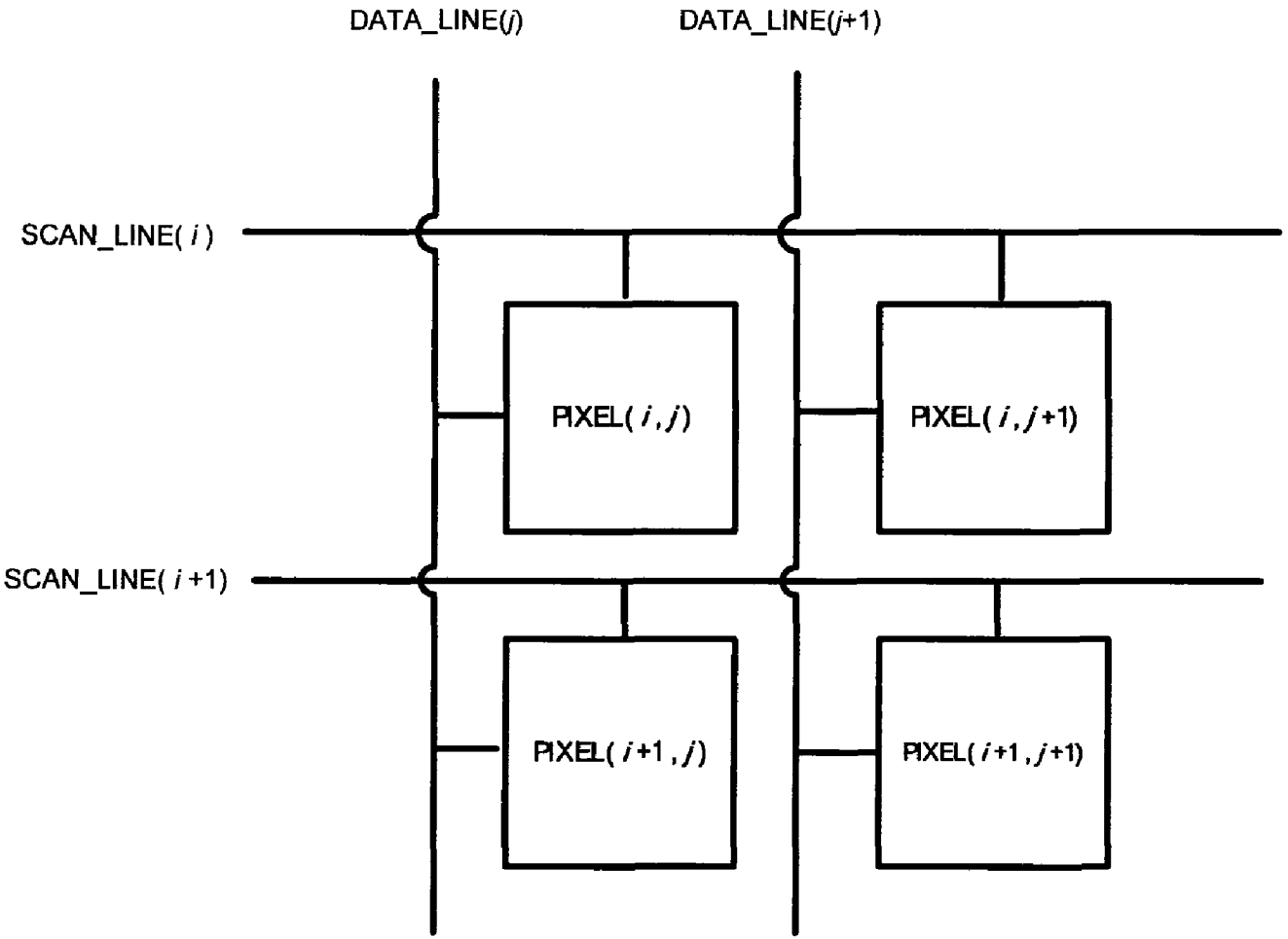

FIGS. 1A-1B are schematic diagrams showing the application of the dot-matrix display data refresh charging/discharging control system of the invention (which is here encapsulated in a box indicated by the reference numeral 70). As shown, the dot-matrix display data refresh charging/discharging control system of the invention 70 is designed for integration to a dot-matrix display device 10, such as a TFT-LCD (Thin Film Transistor Liquid Crystal Display) or an FSC (Field Sequential Color) device, that is equipped with an N×M dot matrix of pixels PIXEL(i,j), where i=1 to N and j=1 to M, i.e., an array of N rows and M columns of pixels. Data display on the dot-matrix display device 10 is controlled by a scan circuit 20 and a data drive circuit 30. The scan circuit 20 is connected with a scan line bus composed of N scan lines [SCAN_LINE(1), SCAN_LINE(2), . . . , SCAN_LINE(N)], while the data drive circuit 30 is connected with a data line bus composed of M data lines [DATA_LINE(1), DATA_LINE (2), . . . , DATA_LINE(M)]. In operation, the scan circuit 20 is capable of sequentially switching the N pixel rows in the dot-matrix display device 10 to an ON state via the N scan lines so that the data voltages to be charged to the pixels can be applied by the data drive circuit 30 to the pixels via the M data lines.

In practice, the dot-matrix display data refresh charging/discharging control system of the invention 70 is particularly designed for use with a polarity-inversion type of dot-matrix display device that charges each pixel with alternating voltage polarities; i.e., if a positive voltage is applied to a certain pixel during the current data refresh action, then a negative voltage is applied to the same pixel during subsequent data refresh action; and vice versa. FIGS. 2A-2D respectively show four different types of polarity inversion schemes that can be used on the dot-matrix display device 10. In FIGS. 2A-2D, it is assumed that the dot-matrix display device 10 is a 5×5 dot matrix; FRAME(N) represents the current video frame and FRAME(N+1) represents the subsequent video frame to be displayed on the dot-matrix display device 10; and the symbol "+" represents a positive data voltage and the symbol "−" represents a negative data voltage. FIG. 2A shows an example of a full-frame scheme for polarity inversion; FIG. 2B shows an example of a row-interleaved scheme; FIG. 2C shows an example of a column-interleaved scheme; and FIG. 2D shows an example of a dot-interleaved scheme.

In actual operation, the dot-matrix display data refresh charging/discharging control system of the invention 70 is capable of controlling the data refresh process on the dot-matrix display device 10 in a fast and power-saving way.

Architecture of the Invention

In system architecture, the dot-matrix display data refresh charging/discharging control system of the invention 70 has four different preferred embodiments for applications with the above-mentioned four different polarity-inversion schemes on the dot-matrix display device 10. These four preferred embodiments are respectively disclosed in details in the following.

Figure 3:
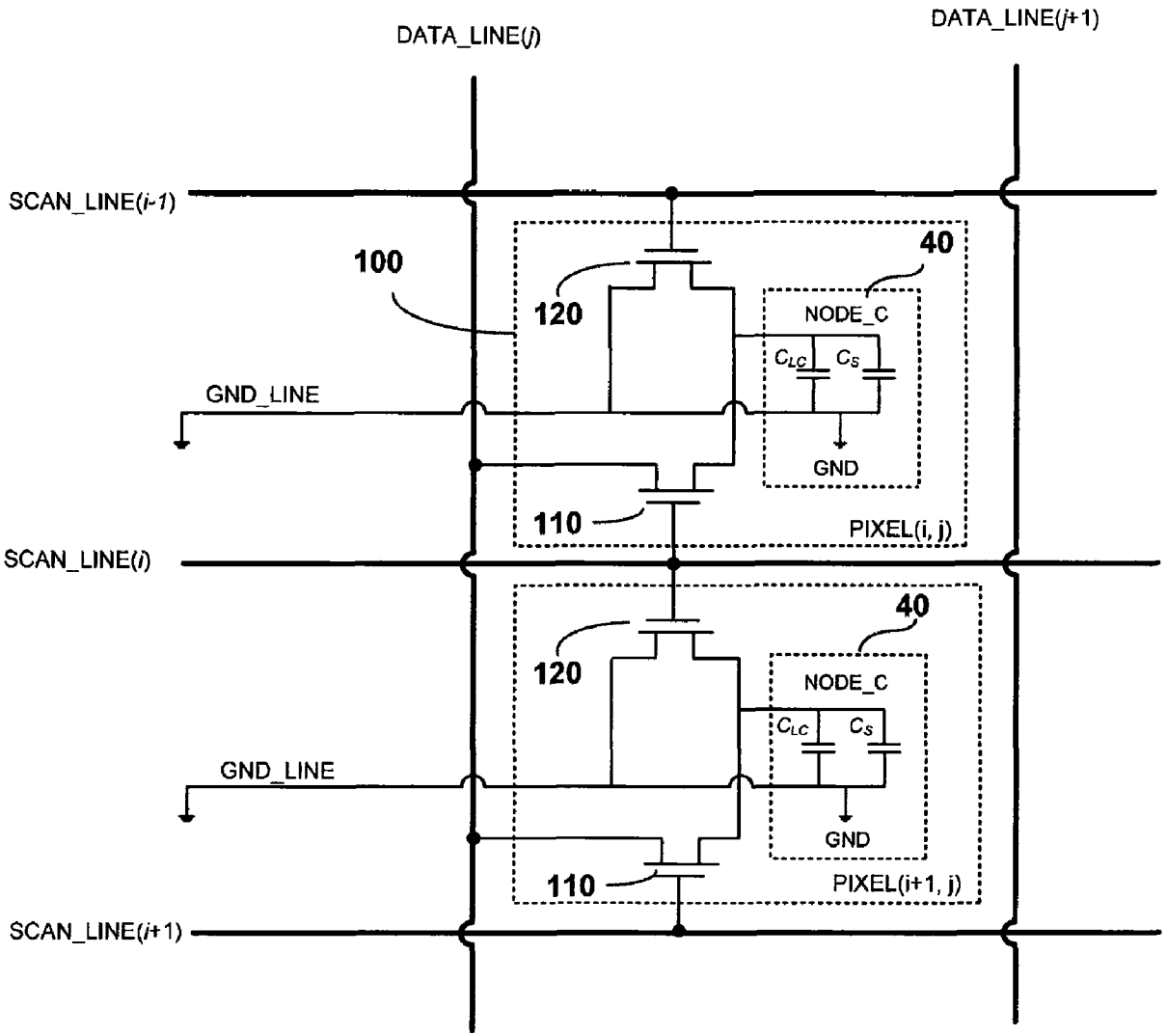
FIG. 3 is a schematic diagram showing the circuit architecture of a first preferred embodiment of the dot-matrix display data refresh charging/discharging control system of the invention.

First Preferred Embodiment (FIG. 3)

As shown in FIG. 3, the first preferred embodiment of the invention 100 is integrated to each pixel of the dot-matrix display device 10. In FIG. 3, only two vertically-adjacent pair of pixels PIXEL(i, j) and PIXEL(i+1, j) are demonstratively shown. Each pixel includes a capacitive circuit 40 having a liquid crystal capacitor $C_{LC}$ and storage capacitor $C_s$, whose two ends are respectively connected to a charge/discharge node NODE_C and a grounding line GND_LINE.

In circuit architecture, the first preferred embodiment of the invention 100 comprises: (A) a charging control switch 110; and (B) a charge-neutralizing control switch 120. The attributes and functions of these two constituent components 110, 120 are described in details in the following.

The charging control switch 110 is for example a TFT (thin-film transistor) switch, which is integrated to each pixel in such a manner that its gate is connected to one of the scan lines of the scan circuit 20, i.e., the gate of the TFT-based charging control switch 110 in PIXEL(i,j) is connected to the (i)th scan line SCAN_LINE(i), while the gate of that in PIXEL(i+1, j) is connected to the (i+1)th scan line SCAN_LINE (i+1); its source is connected to one of the data lines, i.e., the DATA_LINE(j); and its drain is connected to the charge/discharge node NODE_C of the capacitive circuit 40. During operation, when the TFT-based charging control switch 110 is activated by the associated scan line to ON state, it will connect the associated data line to the capacitive circuit 40, thereby allowing the data voltage on the data line to be charged to the capacitive circuit 40.

The charge-neutralizing control switch 120 is for example also a TFT-based switch, which is integrated to each pixel and connected in such a manner that its gate is connected to the preceding row's scan line, i.e., the gate of the TFT-based charge-neutralizing control switch 120 in PIXEL(i+1, j) in the (i+1)th row is connected to the preceding (i)th scan line SCAN_LINE(i); its source is connected to the charge/discharge node NODE_C of the capacitive circuit 40 in the associated pixel; and its drain is connected to a grounding line GND_LINE. During operation, each TFT-based charge-neutralizing control switch 120 will be activated to ON state when the preceding pixel row is activated by the scan circuit 20; and when activated, it will connect the capacitive circuit 40 in the associated pixel to the grounding line GND_LINE, thereby neutralizing the electrical charge on the capacitive circuit 40 to zero voltage level.

In the operation of the dot-matrix display device 10, it will continuously perform a data-refresh process for displaying a sequence of video frames on the dot-matrix display device 10. When a video frame is to be displayed on the dot-matrix display device 10, the scan circuit 20 will sequentially activate each of the pixel rows to a charging-enabled state by switching on the TFT-based charging control switches 110 in the pixel row, thereby allowing the data drive circuit 30 to write data into the pixels in the activated row. Subsequently, when the next video frame is to be displayed, the same process will be repeated again, i.e., the scan circuit 20 will sequentially activate each of the pixel rows to a charging-enabled state by switching on the TFT-based charging control switches 110 in the pixel row to allow the data drive circuit 30 to write data into the pixels in the activated pixel row by charging data voltages thereto.

As shown in FIG. 3, during the foregoing data-refresh process, when the (i)th SCAN_LINE(i) activates the (i)th pixel row to charging-enabled state, it will switch the associated TFT-based charging control switch 110 of the PIXEL(i,j) in the (i)th row to ON state, and meanwhile switch the TFT-based charge-neutralizing control switch 120 of the PIXEL (i+1, j) in the subsequent (i+1)th row to ON state. As a result, when the (i)th pixel row is undergoing charging actions, the subsequent (i+1)th pixel row is undergoing discharging actions by draining the data charges on the capacitive circuit 40 via the grounding line GND_LINE to the ground, thus effectively resetting the subsequent (i+1)th row of pixels to zero voltage level.

Based on a polarity-inversion scheme, the dot-matrix display device 10 will invert the polarity of data voltage applied to each pixel in the subsequent data-refresh process. As a result, the method of neutralizing the previous data charge to zero will allow the new data charge to be more quickly applied to the pixel, thus effectively speeding up the data-refresh process with reduced power consumption.

Figure 4:
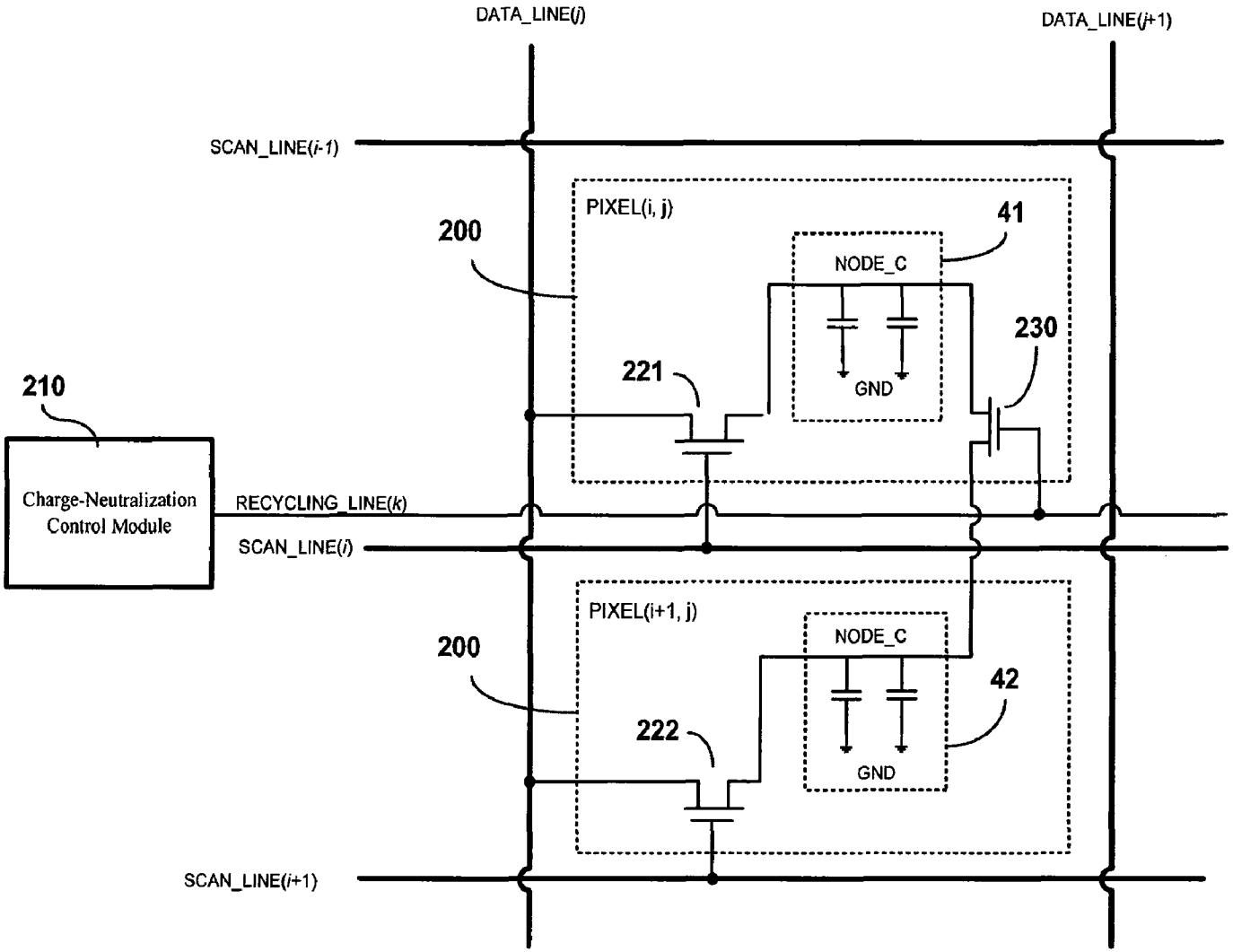
FIG. 4 is a schematic diagram showing the circuit architecture of a second preferred embodiment of the dot-matrix display data refresh charging/discharging control system of the invention.

Second Preferred Embodiment (FIG. 4)

The second preferred embodiment of the invention 200 is specifically designed for use with a dot-matrix display device 10 that utilizes the row-interleaved scheme shown in FIG. 2B or the dot-interleaved scheme shown in FIG. 2D for polarity inversion, where each vertically-adjacent pair of pixels are opposite in data voltage polarity.

As shown in FIG. 4, the second preferred embodiment of the invention 200 is integrated to each vertically-adjacent pair of pixels in the dot-matrix display device 10. In FIG. 4, only one pair of vertically-adjacent pixels PIXEL(i, j) and PIXEL (i+1, j) are demonstratively shown, where the upper PIXEL (i,j) includes a capacitive circuit 41, while the lower PIXEL (i+1, j) includes a capacitive circuit 42. The capacitive circuit 41 in the upper PIXEL(i, j) and the capacitive circuit 42 in the lower PIXEL(i+1, j) are each connected between a charge/discharge node NODE_C and a grounding point GND.

As shown in FIG. 4, in circuit architecture, the second preferred embodiment of the invention 200 comprises: (A) a charge-neutralization control module 210; (B) a first charging control switch 221; (C) a second charging control switch 222; and (D) a charge-neutralizing control switch 230. The attributes and functions of these constituent components 210, 221, 222, 230 are described in details in the following.

The charge-neutralization control module 210 is connected to a bus of control lines, each being associated with one vertically-adjacent pair of pixels (in FIG. 4, only one control line RECYCLING_LINE(k) is demonstratively shown). This charge-neutralization control module 210 operates in synchronization with the scan circuit 20 in such a manner that it will switch the control line RECYCLING_LINE(k) to logic-HIGH voltage state before the scan circuit 20 switches the (i)th pixel row and the (i+1)th pixel row to charging-enabled state.

The first charging control switch 221 is for example a TFT-based switch, which is integrated to the upper PIXEL(i, j), and which is connected in such a manner that its gate is connected to the scan line SCAN_LINE(i); its source is connected to the data line DATA_LINE(j); and its drain is connected to the charge/discharge node NODE_C of the capacitive circuit 41 in the upper PIXEL(i, j). During operation, when this TFT-based charging control switch 221 is activated by SCAN_LINE(i), it will be switched to ON state and thereby connect the data line DATA_LINE(j) to the capacitive circuit 41 in the upper PIXEL(i, j), allowing data voltage to be charged to the capacitive circuit 41.

The second charging control switch 222 is for example also a TFT-based switch, which is integrated to the lower PIXEL (i+1, j), and which is connected in such a manner that its gate is connected to SCAN_LINE(i+1); its source is connected to DATA_LINE(j); and its drain is connected to the charge/discharge node NODE_C of the capacitive circuit 42 in the lower PIXEL(i+1, j). During operation, when this TFT-based second charging control switch 222 is activated by SCAN_LINE(i+1), it will be switched to ON state and thereby connect DATA_LINE(j) to the capacitive circuit 42 in the lower PIXEL(i+1, j), allowing the data voltage on DATA_LINE(j) to be charged to the capacitive circuit 42.

During data-refresh process, every time before the scan circuit 20 switches the (i)th pixel row and the (i+1)th pixel row to charging-enabled state, it will first command the charge-neutralization control module 210 to switch the control line RECYCLING_LINE(k) to logic-HIGH voltage state. This causes the charge-neutralizing control switch 230 to be switched to ON state, thereby connecting the charge/discharge node NODE_C of the capacitive circuit 41 in the upper PIXEL(i,j) to the charge/discharge node NODE_C of the capacitive circuit 42 in the lower PIXEL(i+1, j). Since the upper PIXEL(i, j) and the lower PIXEL(i+1, j) are opposite in voltage polarity, the switch-on of the charge-neutralizing control switch 230 will cause the data voltage charges on the capacitive circuit 41 and the capacitive circuit 42 to be substantially neutralized to zero or close to zero.

Subsequently, the scan circuit 20 first activates SCAN_LINE(i) to switch on the upper PIXEL(i, j) to charging-enabled state for the current data voltage on the data line DATA_LINE (j) to be charged to the capacitive circuit 41 in the upper PIXEL(i, j); and next, the scan circuit 20 activates the subsequent SCAN_LINE(i+1) to switch on the lower PIXEL(i+1, j) to charging-enabled state for the current data voltage on the data line DATA_LINE(j) to be charged to the capacitive circuit 42 in the lower PIXEL(i+1,j).

During the foregoing data-refresh process, since the old data voltages on the vertically-adjacent pair of pixels [PIXEL (i, j), PIXEL(i+1,j)] are mutually neutralized to zero or close to zero voltage level, it allows the new data voltages to be more quickly charged to these pixels, thus effectively speeding up the data-refresh process with reduced power consumption.

Figure 5:
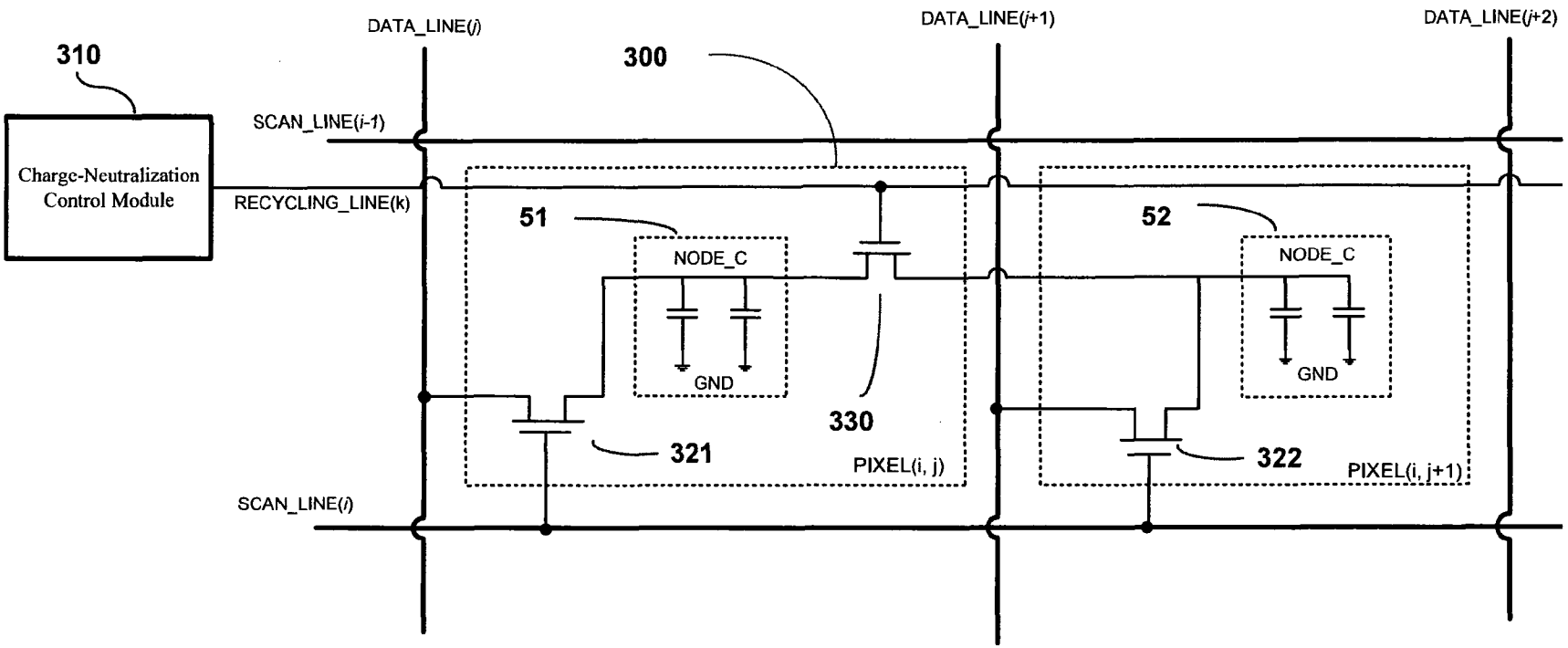
FIG. 5 is a schematic diagram showing the circuit architecture of a third preferred embodiment of the dot-matrix display data refresh charging/discharging control system of the invention.

Third Preferred Embodiment (FIG. 5)

The third preferred embodiment of the invention 300 is specifically designed for use with a dot-matrix display device 10 that utilizes the column-interleaved scheme shown in FIG. 2C or the dot-interleaved scheme shown in FIG. 2D for polarity inversion, where each horizontally-adjacent pair of pixels are opposite in data voltage polarity.

The third preferred embodiment of the invention 300 differs from the second preferred embodiment of the invention 200 only in that the second preferred embodiment of the invention 200 is designed for charge neutralization between each vertically-adjacent pair of pixels, whereas the third preferred embodiment of the invention 300 is designed for charge neutralization between each horizontally-adjacent pair of pixels.

As shown in FIG. 5, the third preferred embodiment of the invention 300 is integrated to each horizontally-adjacent pair of pixels in the dot-matrix display device 10. In FIG. 5, only one pair of horizontally-adjacent pixels [PIXEL(i, j), PIXEL (i, j+1)] are demonstratively shown. The left PIXEL(i, j) includes a capacitive circuit 51, while the right PIXEL(i,j+1) includes a capacitive circuit 52; and the capacitive circuit 51 and the capacitive circuit 52 are each connected between a charge/discharge node NODE_C and a grounding point GND.

As shown in FIG. 5, in circuit architecture, the third preferred embodiment of the invention 300 comprises: (A) a charge-neutralization control module 310; (B) a first charging control switch 321; (C) a second charging control switch 322; and (D) a charge-neutralizing control switch 330. These constituent components 310, 321, 322, 330 of the third preferred embodiment of the invention 300 are identical in structure and function as the constituent components 210, 221, 222, 230 of the second preferred embodiment of the invention 200, so that detailed description thereof will not be repeated.

During data-refresh process, each time before the scan circuit 20 intends to switch on the (i)th pixel row to charging-enabled state, the scan circuit 20 will first command the charge-neutralization control module 310 to activate the control line RECYCLING_LINE(k) to logic-HIGH voltage state, whereby the charge-neutralizing control switch 330 is switched to ON state, thereby connecting the charge/discharge node NODE_C of the capacitive circuit 51 in the left PIXEL(i, j) to the charge/discharge node NODE_C of the capacitive circuit 52 in the right PIXEL(i, j+1). Since the left PIXEL(i, j) and the right PIXEL(i, j+1) are opposite in voltage polarity, the switch-on of the charge-neutralizing control switch 330 will cause the data voltage charges on the capacitive circuit 51 and the capacitive circuit 52 to be substantially neutralized to zero or close to zero voltage level.

Subsequently, the scan circuit 20 activates SCAN_LINE(i) to switch on the left PIXEL(i, j) and the right PIXEL(i, j+1) in the (i)th pixel row to charging-enabled state, whereby the current data voltages on DATA_LINE(j) and data line DATA_LINE(j+1) are respectively charged to the capacitive circuit 51 in the left PIXEL(i, j) and the capacitive circuit 52 in the right PIXEL(i, j+1).

During the foregoing data-refresh process, since the old data voltages on the horizontally-adjacent pair of pixels [PIXEL(i, j), PIXEL(i, j+1)] are mutually neutralized to zero or close to zero voltage level, it allows the new data voltages to be more quickly charged to these pixels, thus effectively speeding up the data-refresh process with reduced power consumption.

Figure 6:
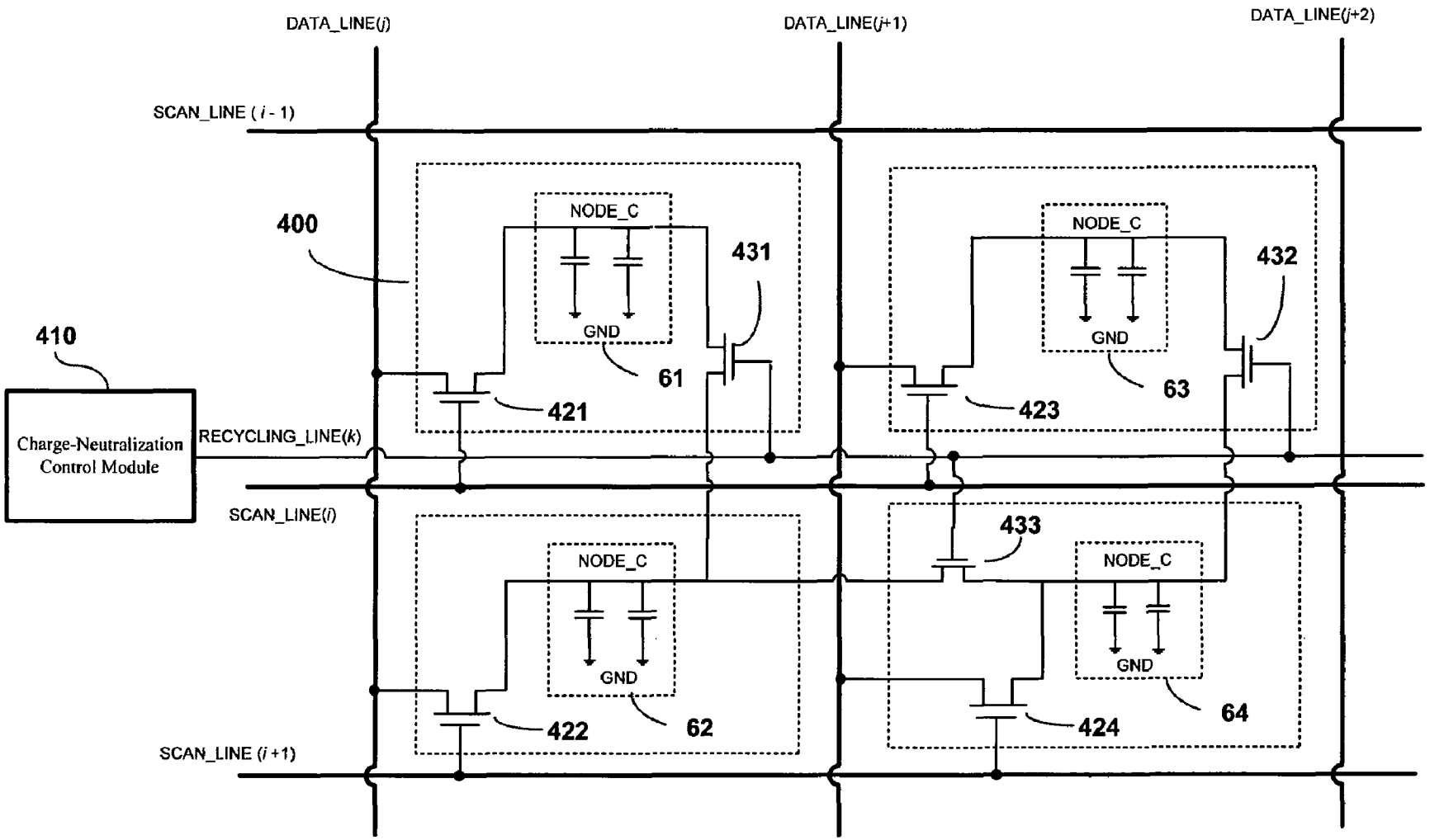
FIG. 6 is a schematic diagram showing the circuit architecture of a fourth preferred embodiment of the dot-matrix display data refresh charging/discharging control system of the invention.

Fourth Preferred Embodiment (FIG. 6)

The fourth preferred embodiment of the invention 400 is specifically designed for use with a dot-matrix display device 10 that utilizes the row-interleaved scheme shown in FIG. 2B, the column-interleaved scheme shown in FIG. 2C, or the dot-interleaved scheme shown in FIG. 2D for polarity inversion, where each 2×2 group of adjacent pixels include 2 positive data voltages and 2 negative data voltages.

The fourth preferred embodiment of the invention 400 differs from the second and third preferred embodiments 200, 300 only in that the fourth preferred embodiment of the invention 400 is designed for charge neutralization of a 2×2 group of adjacent pixels.

As shown in FIG. 6, the fourth preferred embodiment of the invention 400 is integrated to each 2×2 group of adjacent pixels in the dot-matrix display device 10. In FIG. 6, only one 2×2 group of adjacent pixels [PIXEL(i, j), PIXEL(i+1, j), PIXEL(i, j+1), PIXEL(i+1, j+1)] are demonstratively shown. These four pixels each include a capacitive circuit (respectively designated by the reference numerals 61, 62, 63, 64) and are each connected between a charge/discharge node NODE_C and a grounding point GND.

As shown in FIG. 6, in circuit architecture, the fourth preferred embodiment of the invention 400 comprises: (A) a charge-neutralization control module 410; (B) a first charging control switch 421; (C) a second charging control switch 422; (D) a third charging control switch 423; (E) a fourth charging control switch 424; (F) a first charge-neutralizing control switch 431; (G) a second charge-neutralizing control switch 432; and (H) a third charge-neutralizing control switch 433. These components 410, 421, 422, 423, 424, 431, 432, 433 of the fourth preferred embodiment of the invention 400 are identical in structure and function as those used in the second preferred embodiment of the invention 200 and the third preferred embodiment of the invention 300, so that detailed description thereof will not be herein repeated.

During data-refresh process, each time before the scan circuit 20 intends to switch the (i)th pixel row and the (i+1)th pixel row to charging-enabled state, it will first command the charge-neutralization control module 410 to activate the control line RECYCLING_LINE(k) to logic-HIGH voltage state. This action causes all of the first charge-neutralizing control switch 431, the second charge-neutralizing control switch 432, and the third charge-neutralizing control switch 433 to be switched to ON state, thereby interconnecting all of the four capacitive circuits 61, 62, 63, 64 in the 2×2 group of adjacent pixels [PIXEL(i,j), PIXEL(i+1, j), PIXEL(i, j+1), PIXEL(i+1, j+1)] to each other, causing the data voltage charges on the four capacitive circuits 61, 62, 63, 64 to be mutually neutralized to zero or close to zero voltage level.

Subsequently, the scan circuit 20 activates SCAN_LINE(i) to switch on the upper-left PIXEL(i, j) and the upper-right PIXEL(i, j+1) in the (i)th pixel row to charging-enabled state for the current data voltages on DATA_LINE(j) and DATA_LINE(j+1) to be respectively charged to the capacitive circuits 61, 63; and then, the scan circuit 20 activates the subsequent SCAN_LINE(i+1) to switch on the bottom-left PIXEL(i+1, j) and the bottom-right PIXEL(i+1, j+1) in the (i+1)th pixel row to charging-enabled state for the current data voltages on DATA_LINE(j) and DATA_LINE(j+1) to be respectively charged to the capacitive circuits 62, 64.

During the foregoing data-refresh process, since the old data voltages on the 2×2 group of adjacent pixels [PIXEL(i, j), PIXEL(i+1, j) PIXEL(i, j+1), PIXEL(i+1, j+1)] are mutually neutralized to zero or close to zero voltage level, it allows the new data voltages to be more quickly charged to these pixels, thus effectively speeding up the data-refresh process with reduced power consumption.

Broadly speaking, beside the above-disclosed 2×1, 1×2, and 2×2 groups of adjacent pixels, the invention can also be designed for charge neutralization of a larger group of adjacent pixels. However, the charge neutralization of a larger group of adjacent pixels will correspondingly require more complex circuit structure for implementation.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A dot-matrix display data refresh charging/discharging control system for integration to a dot-matrix display device of the type having an array of pixels which are capable of displaying particular color values by charging with particular data voltages, and which are interconnected with a scan line bus and a data line bus, and each include a capacitive circuit connected between a charge/discharge node and a grounding point for holding data voltage charge;

the dot-matrix display data refresh charging/discharging control system comprising:

a charge-neutralization control module, which is capable of sequentially generating a sequence of charge-neutralizing control signals;

a first charging control switch, which is integrated to a first pixel in an adjacent pair of pixels in the dot-matrix display device, and which has a gate, a source, and a drain; and whose gate is connected to a first scan line in the scan line bus; whose source is connected to a corresponding data line in the data line bus; and whose drain is connected to the capacitive circuit of the first pixel; and which is capable of being switched on by activation on the associated scan line to allow a data voltage on the associated data line to be charged to the capacitive circuit of the first pixel;

a second charging control switch, which is integrated to a second pixel in the adjacent pair of pixels, and which has a gate, a source, and a drain; and whose gate is connected to a second scan line in the scan line bus; whose source is connected to a corresponding data line in the data line bus; and whose drain is connected to the capacitive circuit of the second pixel; and which is capable of being switched on by activation on the associated scan line to allow a data voltage on the associated data line to be charged to the capacitive circuit of the second pixel; and a charge-neutralizing control switch, which has a gate, a source, and a drain; and whose gate is connected to a corresponding control line of the charge-neutralization control module; whose source is directly connected to the associated capacitive circuit of the first pixel in the adjacent pair of pixels; and whose drain is directly connected to the associated capacitive circuit of the second pixel in the adjacent pair of pixels; and which is capable of being switched on by activation on the associated control line to connect the capacitive circuit of the first pixel to the capacitive circuit of the second pixel for the purpose of neutralizing the current data voltage charges on the first pixel and the second pixel to substantially approach zero voltage level.

2. The dot-matrix display data refresh charging/discharging control system as recited in claim 1, wherein the dot-matrix display device is a TFT-LCD (Thin Film Transistor-Liquid Crystal Display) device.

3. The dot-matrix display data refresh charging/discharging control system as recited in claim 1, wherein the dot-matrix display device is an FSC (Field Sequential Color) device.

4. The dot-matrix display data refresh charging/discharging control system as recited in claim 1, wherein the first charging control switch and the second charging control switch are each a thin-film transistor (TFT).

5. The dot-matrix display data refresh charging/discharging control system as recited in claim 1, wherein the charge-neutralizing control switch is a thin-film transistor (TFT).

6. The dot-matrix display data refresh charging/discharging control system as recited in claim 1, wherein the adjacent pair of pixels are row-oriented adjacent pair of pixels.

7. The dot-matrix display data refresh charging/discharging control system as recited in claim 1, wherein the adjacent pair of pixels are column-oriented adjacent pair of pixels.

* * * * *